US010468733B2

(12) United States Patent
Burgess et al.

(10) Patent No.: US 10,468,733 B2
(45) Date of Patent: Nov. 5, 2019

(54) CERAMIC BLOCK FILTER HAVING THROUGH HOLES OF SPECIFIC SHAPES

(71) Applicant: LGS INNOVATIONS LLC, Herndon, VA (US)

(72) Inventors: Scott William Burgess, Albuquerque, NM (US); Jeffery Jan Nummerdor, Jr., Rio Rancho, NM (US); Alan Scott Brannon, Denver, CO (US)

(73) Assignee: LGS Innovations LLC, Herndon, VA (US)

( * ) Notice: Subject to any disclaimer, the term of this patent is extended or adjusted under 35 U.S.C. 154(b) by 0 days.

(21) Appl. No.: 15/718,832

(22) Filed: Sep. 28, 2017

(65) Prior Publication Data

US 2018/0131061 A1 May 10, 2018

Related U.S. Application Data

(60) Provisional application No. 62/418,994, filed on Nov. 8, 2016.

(51) Int. Cl.

| | |
|---|---|
| ***H01P 1/205*** | (2006.01) |
| ***H01P 11/00*** | (2006.01) |
| ***H01P 1/20*** | (2006.01) |
| ***H01P 7/04*** | (2006.01) |

(52) U.S. Cl.

CPC ..... *H01P 1/2056* (2013.01); *H01P 1/2002* (2013.01); *H01P 7/04* (2013.01); *H01P 11/007* (2013.01)

(58) Field of Classification Search

CPC ..... H01P 1/2056; H01P 7/04

USPC ..... 333/206, 222

See application file for complete search history.

(56) References Cited

U.S. PATENT DOCUMENTS

| | | | | |
|---|---|---|---|---|
| 4,523,162 A * | 6/1985 | Johnson | H01P 1/2056 | 29/600 |
| 5,436,602 A * | 7/1995 | McVeety et al. | H01P 1/2056 | 333/206 |
| 6,448,871 B1 * | 9/2002 | Hiroshima et al. | H01P 1/2056 | 333/134 |
| 6,556,101 B1 * | 4/2003 | Tada et al. | H01P 1/2056 | 333/134 |

OTHER PUBLICATIONS

English language abstract of Japanese patent publication 61-214801 to Ichiro Koyama, published on Sep. 24, 1986. (Year: 1986).*

* cited by examiner

*Primary Examiner* — Benny T Lee

(74) *Attorney, Agent, or Firm* — Baker & Hostetler LLP

(57) ABSTRACT

The present application is directed to a filter and methods of making the same. The filter includes a block of dielectric material with a top surface including a patterned region, a bottom surface, and side surfaces. The filter also includes a through-hole extending through the block from the top surface to the bottom surface. The through-hole may include a top edge that connects the top surface with an inner wall of the through hole and a bottom edge that connects the bottom surface with the inner wall of the through hole. The top edge or bottom edges of the through-hole may be rounded, chamfered, or tapered.

17 Claims, 6 Drawing Sheets

CERAMIC BLOCK FILTER HAVING THROUGH HOLES OF SPECIFIC SHAPES

CROSS-REFERENCE TO RELATED APPLICATIONS

This application claims the benefit of priority of U.S. Provisional Application No. 62/418,994 filed Nov. 8, 2016, entitled "Ceramic Filters With Improved Electrical Performance," the contents of which is incorporated by reference in its entirety herein.

FIELD

This application is generally related to an apparatus and method for improving the Q factor of a ceramic filter.

BACKGROUND OF THE INVENTION

In the basic ceramic block filter design, the resonators are formed by typically cylindrical passages, called resonator cavities (e.g., through-holes), extending through the block from the long narrow side to the opposite long narrow side. The block is substantially plated with a conductive material (e.g., metallized) on all but one of its six (outer) sides and on the inside walls formed by the resonator cavities. One of the two opposing sides containing resonator cavity openings is not fully metallized, but instead bears a metallization pattern designed to couple input and output signals through the series of resonator cavities. This patterned side is conventionally labeled as the top of the block. In some designs, the pattern may extend to sides of the block, where input/output electrodes are formed. Ceramic filter performance is limited by electromagnetic losses due to many factors.

SUMMARY OF THE INVENTION

Filter performance may be limited by electromagnetic losses in materials used including dielectric material and materials used for conducting paths and pads. Further, geometries of shapes of different elements or portions of elements may affect the performance of a given filter. In ceramic monoblock filters, such as a recessed top pattern (RTP) technology, loss mechanisms arise from current crowding at a sharp junction between the resonator-plated through-hole (e.g., resonator cavities) and the short circuit end at the bottom of the ceramic block. What are needed in the art are methods and devices for optimizing the performance of a device by optimizing the shape of magnetic structures and dielectric sub-elements to minimize losses. Rounding, tapering, or chamfering the edges of the resonator cavities reduces the current crowding, reducing RF losses and improving power handling due to better thermal management.

In an example, a filter may include a block of dielectric material and a through-hole extending through the block from a top surface to a bottom surface of the dielectric block. The dielectric block may include a top surface, a bottom surface, and side surfaces. The through hole comprises a top edge that connects the top surface with an inner wall of the through hole and a bottom edge that connects the bottom surface with the inner wall of the through hole. The top edge or bottom edge may be rounded, chamfered, tapered, or the like.

In another example, a method of creating a filter may include providing a block of dielectric material for a filter, the block may include a top surface, a bottom surface, and a side surfaces; and creating a through-hole extending through the block from the top surface to the bottom surface. The through hole may include a top edge that connects the top surface with an inner wall of the through-hole and a bottom edge that connects the bottom surface with the inner wall of the through-hole. The top edge or bottom edge may be rounded, chamfered, tapered, or the like.

There has thus been outlined, rather broadly, certain examples of the invention in order that the detailed description thereof herein may be better understood, and in order that the present contribution to the art may be better appreciated. There are, of course, additional examples of the invention that will be described below and which will form the subject matter of the claims appended hereto.

BRIEF DESCRIPTION OF THE DRAWINGS

In order to facilitate a fuller understanding of the invention, reference is now made to the accompanying drawings, in which like elements are referenced with like numerals. These drawings should not be construed as limiting the invention and intended only to be illustrative.

DETAIL DESCRIPTION OF THE INVENTION

Disclosed herein are exemplary methods, systems, and apparatus associated with shaping structures of filters. The methods, systems, and apparatus for shaping structures of a filter may reduce RF losses and improve power handling, among other things.

Figure 1:
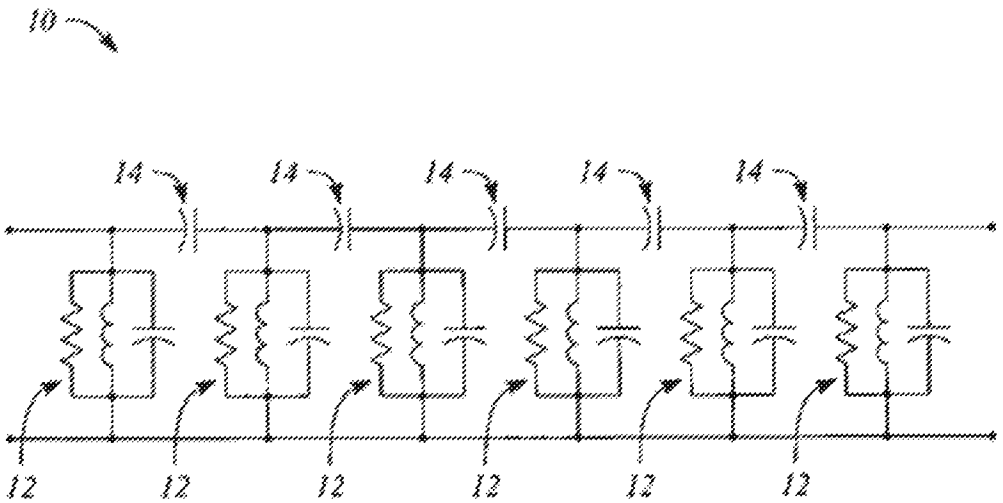
FIG. 1 illustrates an exemplary equivalent circuit for a monoblock filter.

FIG. 1 illustrates an exemplary equivalent circuit for a monoblock filter. Conventionally, when equivalent circuits 10 are drawn for a monoblock filter, such as equivalent circuit 10, they do not show a complete model for a given monoblock filter. Most drawings or implementations of equivalent circuits 10 for a monoblock filter fail to incorporate real world equivalent resistive elements that play into the performance of a monoblock filter implemented using a given topology and given conductive material. In the equivalent circuit of FIG. 1 in reality there are resistive elements in all series paths—small resistance in series with all resistor (R), inductor (L), a capacitor (C)—(RLC) combinations 12 and in series with input and output paths as well as in series with all capacitors 14. These resistances operate to lower the performance of a given device (e.g., filter which may include a monoblock filter) with respect to achievable Q (electrical charge) as they operate to dissipate energy, thus, lowering the effective Q of the monoblock filter.

As the frequency of operation of a device (e.g., monoblock filter) increases, the equivalent sizes of the series and parallel resistive elements, sometimes referred to as parasitic resistances, increase due to skin effects, current crowding, or uneven field distributions. This has the effect of lowering the Q of the device as greater valued resistive elements dissipate more energy.

Applying shaping of structures as disclosed herein lowers the values of equivalent series or parallel resistances with resultant increases in performance of the filter (monoblock filter) including improving the achievable Q for the filter.

Figure 2A:
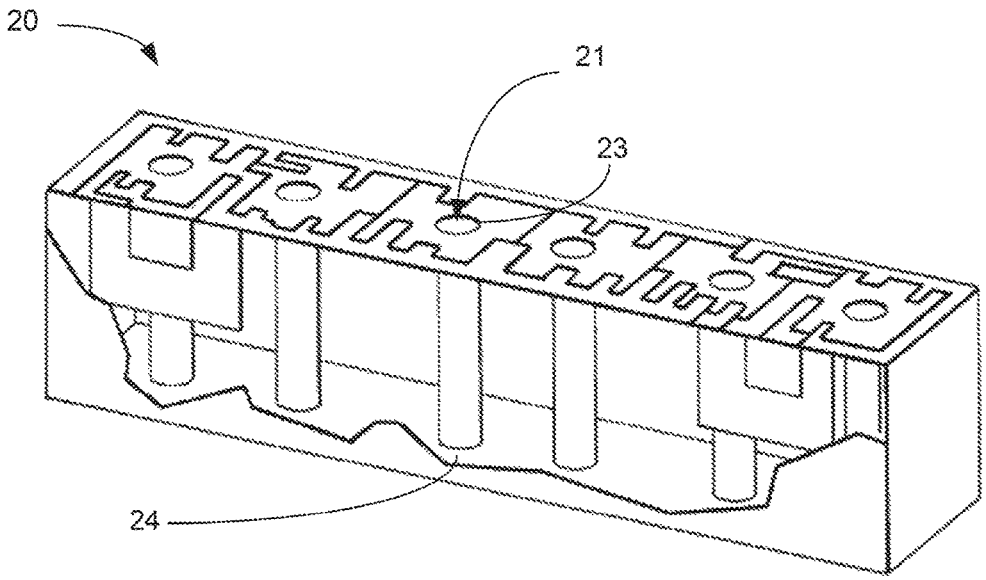
FIG. 2A PRIOR ART
FIG. 2A illustrates an exemplary conventional monoblock filter.
Figure 2B:
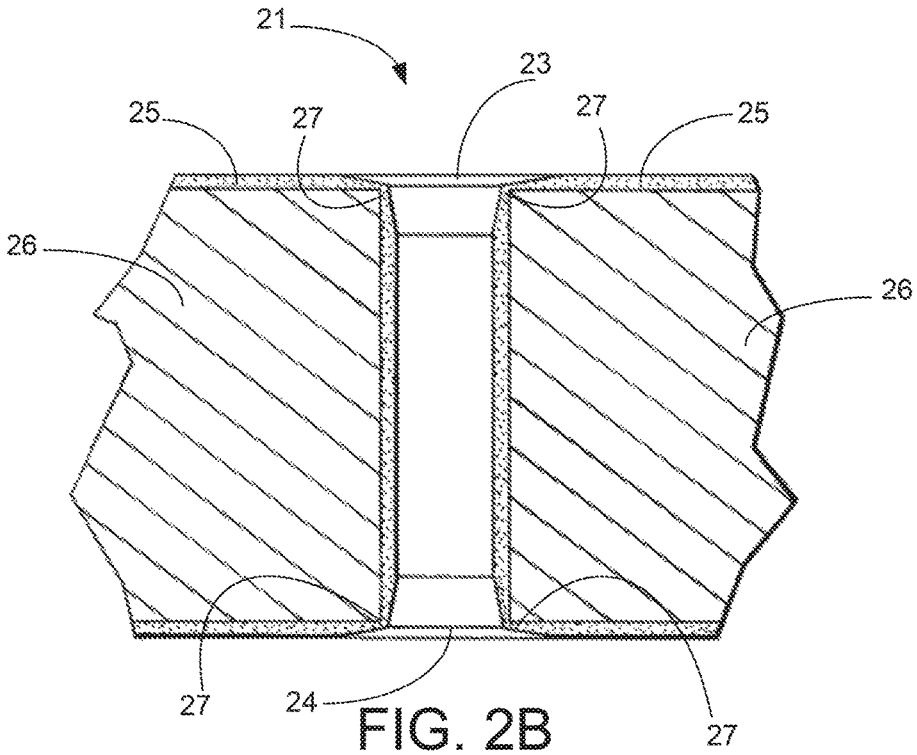
FIG. 2B PRIOR ART
FIG. 2B illustrates an exemplary cross-sectional view of a conventional monoblock filter

FIG. 2A illustrates an exemplary conventional monoblock filter 20 (e.g., recessed top pattern type—RTP). Monoblock filter 20 includes multiple resonator cavities, such as resonator cavity 21. Resonator cavity 21 is a through-hole in monoblock filter 20 and has top cavity entry 23 and bottom cavity entry 24. Bottom cavity entry 24 may be at the short circuit end. FIG. 2B illustrates an exemplary cross-sectional view of monoblock filter 20 of FIG. 2A. As shown, monoblock filter 20 may be a block that includes a dielectric material 26 (e.g., ceramic, glass, plastic) and conductive material 25 (e.g., silver or copper).

With continued reference to FIG. 2A-FIG. 2B, conductive material 25 may be placed on dielectric material 26 based on a plating process. Plating of resonator cavity 21 is difficult, especially around the sharp edges (e.g., approximately 90 degrees) of the through-holes. As shown in FIG. 2B, approximate to sharp edge 27, conductive material 25 tapers. A conventional method, for example, is to inject conductive material 25 (e.g., silver in paste form) into resonator cavity 21 and then vacuum conductive material 25 out of resonator cavity 21. After this process, it leaves a thin layer along the length of the surface of resonator cavity 21. At the edge of resonator cavity 21, there are adhesive forces (attracting of conductive material 25 molecules to the surface of dielectric material 26) and cohesive forces (attraction of conductive material 25 molecules to each other). Because of these forces, a capillary effect (e.g., similar to a meniscus in a test tube) cause the plating around sharp edge 27 of resonator cavity 21 to consistently be thinner than the inner surface plating of resonator cavity 21 (see FIG. 2B). There is a drying and firing process used to melt conductive material 25 in order to plate onto dielectric material 26. Once resonator cavities 21 are plated, the remaining dielectric material 26 of the block of soon to be monoblock filter 20 is plated by spraying silver using a spray gun. Even with this process, it is difficult to maintain a consistent plating at sharp edges 27 of resonator cavity 21.

The thin plating at sharp edge 27 causes current pinching, particularly if in a high current area (e.g., short circuited area near bottom cavity entry 24) and if conductive material 25 is too thin (<3 skin depth) at RF frequencies radiation losses can occur reducing the overall Q of the resonator. SkinDepth=(2*resistivity/(2*pi*frequency*permeability))^ 0.5, wherein silver is measured in micro inches. Q is defined as 2π*(total stored energy)/(Lost energy losses in one RF cycle), so decreasing lost energy increases Q. Rounding (e.g., curved like part of a circle), tapering, or chamfering sharp edges 27 reduces the current crowding, reducing RF losses, and improving power handling, which may be due to better thermal management.

Figure 3A:
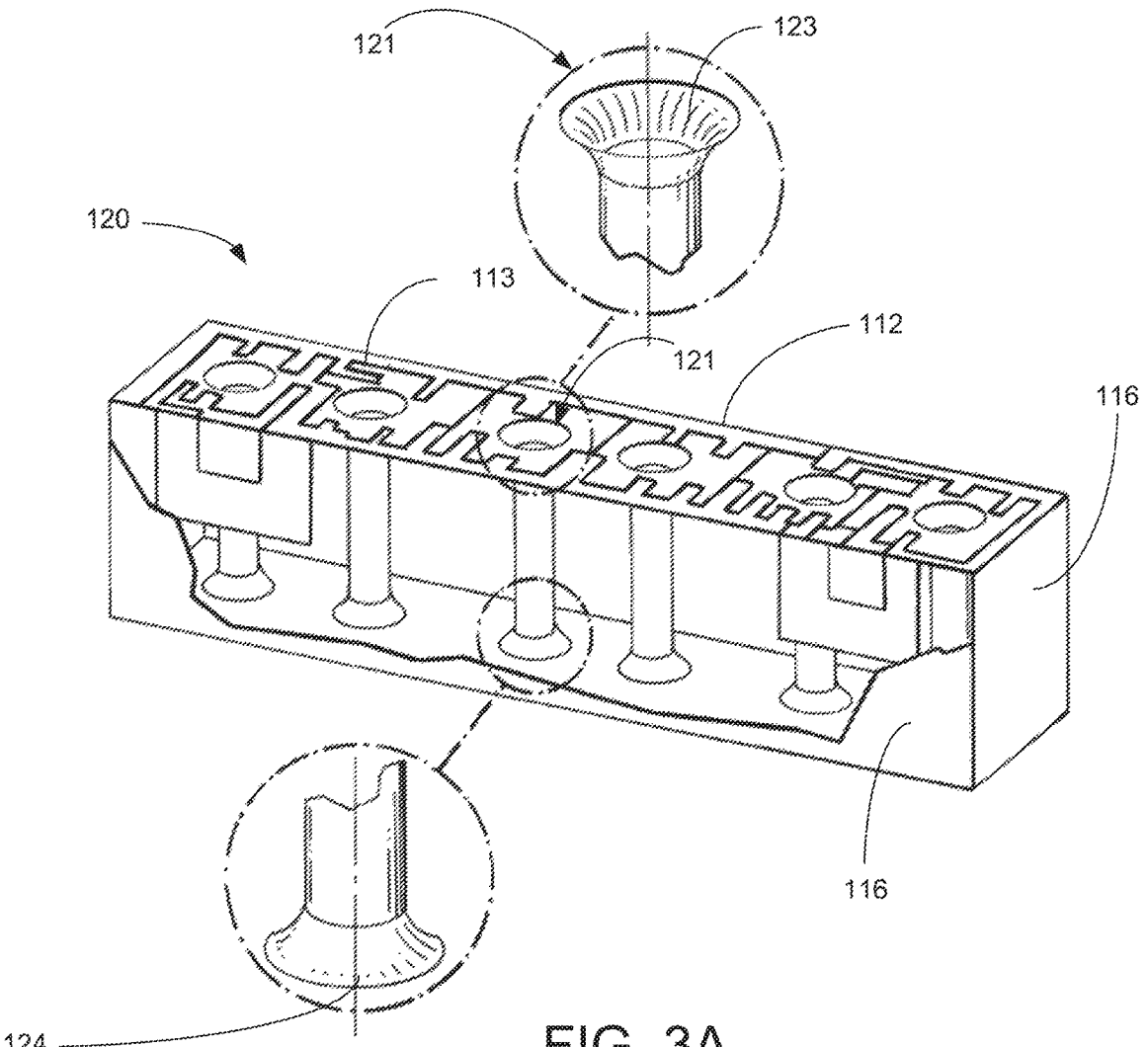
FIG. 3A illustrates an exemplary perspective view of a monoblock filter.
Figure 3B:
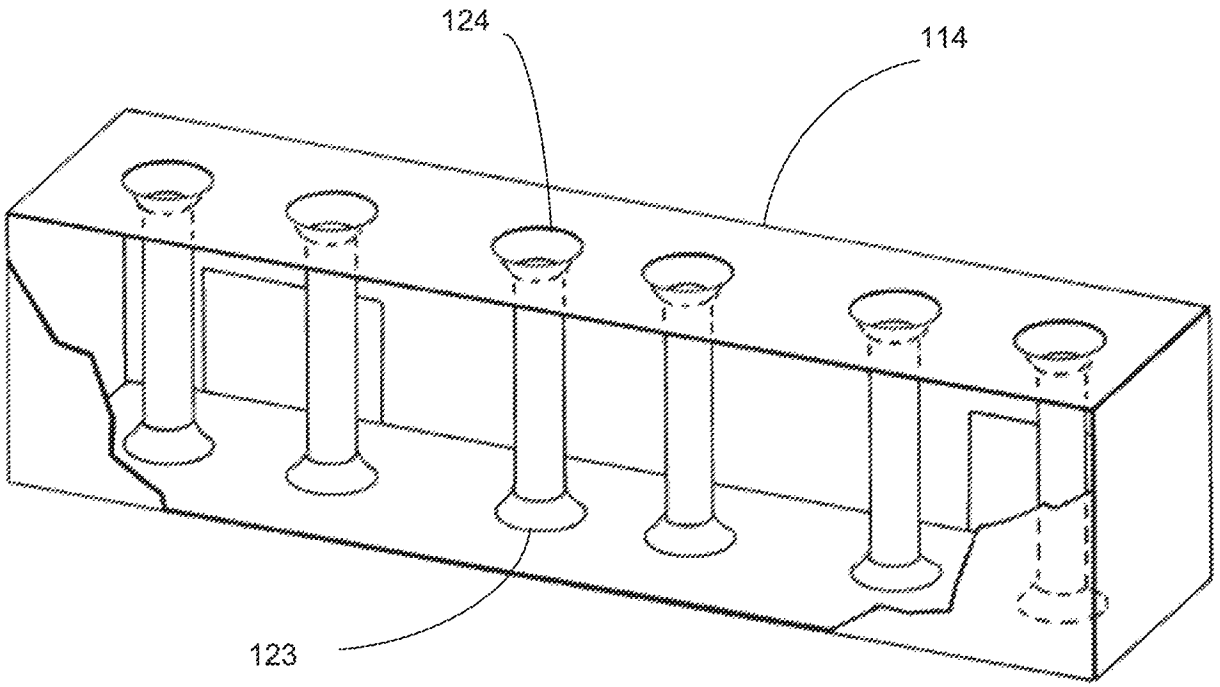
FIG. 3B illustrates an exemplary bottom perspective view of a monoblock filter.
Figure 4:
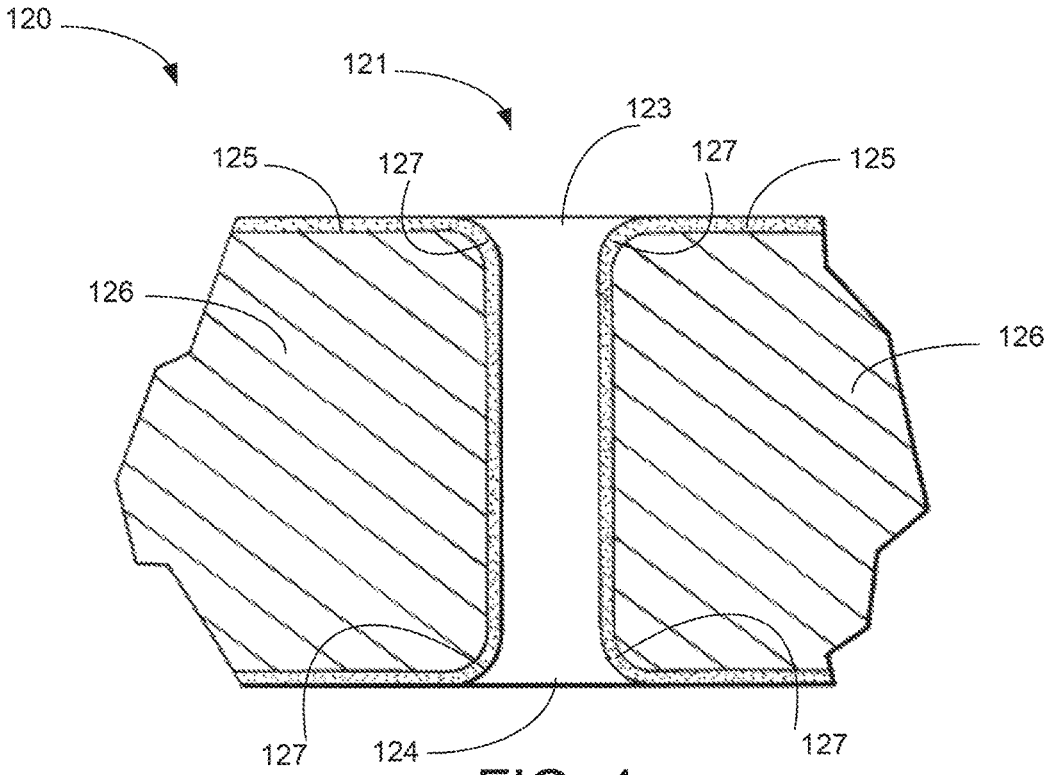
FIG. 4 illustrates an exemplary cross-sectional view of a monoblock filter.

FIG. 3A illustrates an exemplary perspective view of a monoblock filter 120, which incorporates a shaping feature, as disclosed herein. FIG. 3B illustrates an exemplary bottom perspective view of the monoblock filter 120 of FIG. 3A. Monoblock filter 120 includes a block composed of dielectric material and selectively plated with conductive material (e.g., copper or silver), as shown in FIG. 4. Monoblock filter 120 has top surface 112 of FIG. 3A that includes top cavity entry 123 for resonator cavity 121 of FIG. 3A, bottom surface 114 of FIG. 3B that includes bottom cavity entry 124 for resonator cavity 121, and four side surfaces 116 (e.g., faces as shown in FIG. 3A). As shown in FIG. 4, monoblock filter 120 may be constructed of dielectric material 126 that has low loss, a high dielectric constant, and a low temperature coefficient. Top surface 112 of FIG. 3A may include a patterned region, in which resonator cavity 121 is at least partially surrounded by the patterned region. Generally, a pattern of metallized and un-metallized areas is defined on monoblock filter 120. The pattern (e.g., pattern 113 as shown in FIG. 3A) may include a recessed area of metallization that covers at least a portion of top surface 112 of FIG. 3A and areas that may cover side surfaces 116. The metallized areas are preferably a surface layer of conductive material 125 (e.g., silver-containing material). Recessed pattern, such as pattern 113, may define a wide area or pattern of metallization that covers the surface (e.g., top surface 112 of FIG. 3A).

With continued reference to FIG. 3A and FIG. 3B, monoblock filter 120 includes six (6) resonator cavities 121 (e.g., through-holes), each extending from top surface 112 to bottom surface 114. The plated resonator cavity 121 may be considered a transmission line pole comprised of a short-circuited coaxial transmission line having a length selected for desired filter response characteristics. Although monoblock filter 120 is shown with six plated resonator cavities 121, it is contemplated herein that there may be more or less resonator cavities 121 than provided in FIG. 3A and FIG. 3B.

Figure 5:
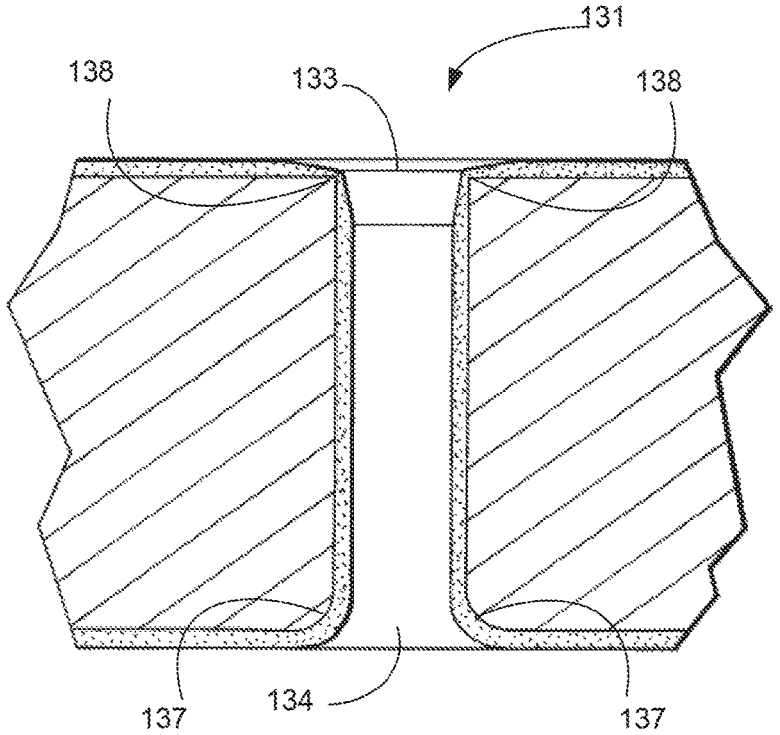
FIG. 5 illustrates an exemplary cross-sectional view of a monoblock filter.

FIG. 4 illustrates an exemplary cross-sectional view of monoblock filter 120. Monoblock filter 120 comprises resonator cavity 121 in which there are rounded edges 127 (e.g., having smooth curved surface) at bottom cavity entry 124 and top cavity entry 123. Dielectric material 126 and therefore conductive material 125 are rounded. FIG. 5 illustrates an exemplary cross-sectional view of a monoblock filter. Resonator cavity 131 includes rounded edges 137 at bottom cavity entry 134 (e.g., short circuit end) and sharp edges 138 at top cavity entry 133. As disclosed herein, the effect of rounded edges may be more significant at the short-circuited end, therefore cost in view of filter performance or other factors may influence whether to place rounded edges on the top and bottom of resonator cavity 131.

Figure 6:
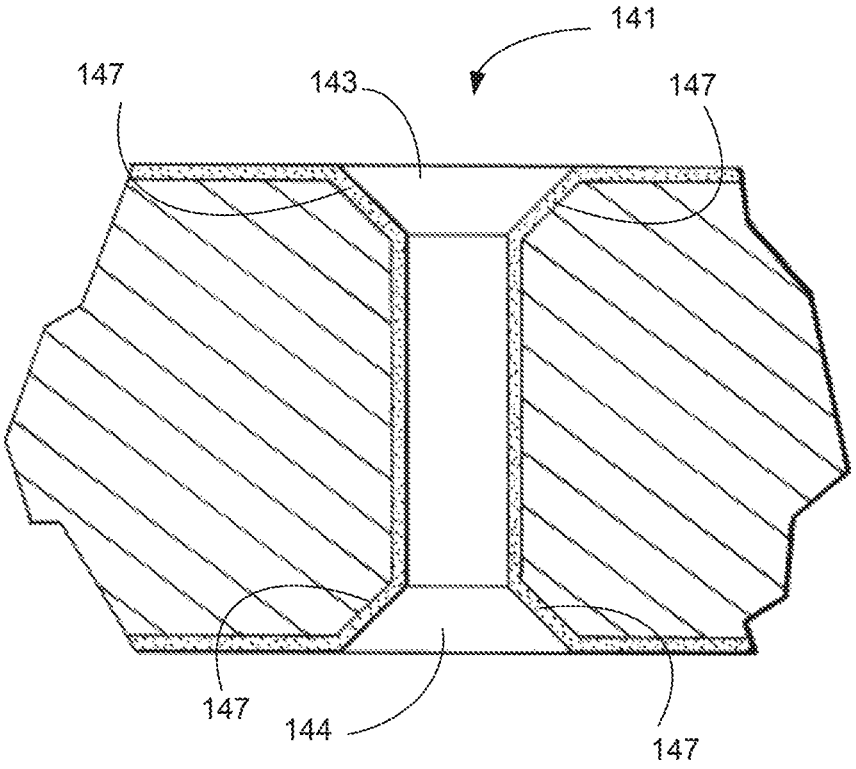
FIG. 6 illustrates a cross-sectional view of resonator cavity of a monoblock filter.

Alternative to rounded edges are tapered or chamfered edges of the dielectric material (and therefore the conductive material) at the entry to a resonator cavity. FIG. 6 illustrates a cross-sectional view of resonator cavity 141 of a monoblock filter. Resonator cavity 141 includes chamfered edges 147 at bottom cavity entry 144 (e.g., short circuit end) and chamfered edges 147 at top cavity entry 143. As disclosed herein, the effect of chamfered edges may be more significant at the short-circuited end, but the placement of chamfered, rounded, or tapered edges at bottom cavity entry 144 or top cavity entry may be based on multiple factors, such as cost in view of filter performance. It is contemplated herein that there may be any combination of rounded, chamfered, tapered, or sharp edges at the resonator cavity.

For further perspective, attention is turned back with regard to some of the effects of easing the sharpness of edges, such as rounded edges 127 of FIG. 4 or chamfered edges 147 of FIG. 6. Monoblock filter 120 of FIG. 3A and FIG. 3B may be a ceramic monoblock filter. Resonator cavities 121 may be formed and fired together as a single ceramic block, forming a monoblock that may have electromagnetic field coupling between resonator cavities 121 occurring through the bulk material. This may be a significant factor with regard to rounding, chamfering, or the like.

Rounding of edges for dielectric material 126 help maintain a constant plating thickness. This in turn allows for edges of resonator cavities 121 to apply (e.g., spray) conductive material more evenly and thicker. The thicker plating reduces current pinching and eliminates radiation losses because of metal having skin depth >3 may better be maintained. This increases the overall Q, which translates to better overall performance of the filter. The disclosed shaping reduces these resistances by limiting current crowding and uneven field distributions. This results in reducing the amount of energy dissipated in a given resonant and other structures thereby increasing the effective Q of the overall filter.

A primary source of changing the value of resistive elements is current crowding which occurs especially in areas where resistance to current flows is lowered in localized areas or in areas where the field strength, E and H, is concentrated, for example at the edges of layers, at bends, or at other areas where sharp changes in geometries of either dielectric structures of conducting paths occur. Current crowding is a nonhomogeneous distribution of current density at a given point or area.

Rounding the edges at the bottoms of resonators advantageously minimizes current crowding at the transition between the column for which the walls are plated, and the RF ground plane at the flat bottom of the filter structure. Current crowding at this transition point in conventional architecture is caused by uneven, severe field perturbations that occur at the transition point. As discussed herein, current crowding is further exacerbated at the transition point in conventional architecture designs by the non-uniformity of plating material at the transition. For example, as silver is heated it may pull into itself and away from sharp edges in a way that creates a meniscus shape.

In a further example, rounded edges on the top side of the ceramic device (e.g., the high voltage side or low current side of the filter) produces improvements on filter performance. The benefit of rounding edges of resonator structures is envisaged to be optimal where current is the greatest (e.g., on the bottom side of the device). The bottom of resonator cavity 121 may produce a short circuit where the voltage is zero and current is at a maximum.

In another example, it is advantageous for processing in manufacturing where filters are tumbled to round off edges and it may be difficult not to round off edges on both sides of a ceramic block. For plating reasons, rounding edges of both sides may provide a consistent coating at the flat-surface-face to resonator column junction. Moreover, to some of the issues disclosed herein, pressing, lapping and grinding the blocks creates a ridge around the hole and, in some instances, the plating process does not plate under the ridge. Rounding the edges of the resonator structures eliminates this problem.

Further, advantages of rounding corners on the upper and lower sides may be applicable to certain types of filters, for example, interdigital filters where resonators alternate between open and shorted resonators on each side of the block. In addition, power handling capabilities of a device can be improved as buildup of field strength is thereby minimized, thereby decreasing the likelihood or arcing.

The shaping disclosed herein may reduce the effective values and effects of resistive elements in the device. By so doing, power handling capabilities may be increased when compared to conventional devices. Lower effective resistance has the effect of lowering power dissipation in the device, thereby lowering thermal heating effects. Hence, the device is capable of handling higher power signals, such as, when the filter is used in the transmit path either by itself or as the transmit filter part of a duplex filter combination.

In structures with magnetic properties, the distribution of Electric and Magnetic fields (E and H fields, respectively) become non-uniform at points in the structure where sharp edges occur. Modeling and analysis of these distributions are very complex. However, in general, it is noted that field distributions at given points in a structure may be made more even by lessening the severity of the transition between a given point in a structure and adjacent structure, illustratively, by making the transition more gentle using applications of planar to circular geometric transitions. Enabling the transition to be more gentle using applications of planar to circular geometric transitions lends itself to manufacturability. Mathematically speaking, it may be shown that a transition between a straight surface and a circular structure minimizes the geometric perturbation due to the transition. In a field theory sense, as similarly shown mathematically speaking, a transition between a flat structure and a circular structure minimizes the perturbation to field distributions. This lowers effective resistive dissipation of energy at the transition. This is due to the phenomena in which for the same amount of resistance across a given area, a lower current flow results in lower energy dissipation, thus increasing the effective Q.

While the system and method have been described in terms of what are presently considered to be specific examples, the disclosure need not be limited to the disclosed examples. It is intended to cover various modifications and similar arrangements included within the spirit and scope of the claims, the scope of which should be accorded the broadest interpretation so as to encompass all such modifications and similar structures. The present disclosure includes any and all examples of the following claims.

In this respect, before explaining at least one example of the invention in detail, it is to be understood that the invention is not limited in its application to the details of construction and to the arrangements of the components set forth in the following description or illustrated in the drawings. The invention is capable of examples in addition to those described and of being practiced and carried out in various ways. Also, it is to be understood that the phraseology and terminology employed herein, as well as the abstract, are for the purpose of description and should not be regarded as limiting.

Reference in this application to "one example," "an example," "one or more examples," or the like means that a particular feature, structure, or characteristic described in connection with the example is included in at least one example of the disclosure. The appearances of, for example, the phrases "an example" in various places in the specification are not necessarily all referring to the same example, nor are separate or alternative examples mutually exclusive of other examples. Moreover, various features are described which may be exhibited by some examples and not by the other. Similarly, various requirements are described which may be requirements for some examples but not by other examples.

What is claimed is:

1. A filter comprising:

a block of dielectric material with a top surface, a bottom surface, and side surfaces; and a through-hole extending through the block from the top surface to the bottom surface, wherein:

the through hole comprises a top edge that connects the top surface with an inner wall of the through hole and a bottom edge that connects the bottom surface with the inner wall of the through hole, the through-hole is partially surrounded by a patterned region, the top edge is chamfered, and the bottom edge is chamfered.

2. The filter of claim 1, wherein the filter is a ceramic monoblock filter.

3. The filter of claim 1, wherein the bottom edge corresponds with a short circuit end of the filter.

4. The filter of claim 1, wherein the through-hole is plated with a conductive material.

5. The filter of claim 1, wherein the filter is a monoblock filter.

6. A filter comprising:

a block of dielectric material with a top surface, a bottom surface, and side surfaces; and a through-hole extending through the block from the top surface to the bottom surface, wherein:

the through hole comprises a top edge that connects the top surface with an inner wall of the through hole and a bottom edge that connects the bottom surface with the inner wall of the through hole, the bottom edge is chamfered, the bottom edge corresponds with a short circuit end of the filter, and the top edge is chamfered.

7. The filter of claim 6, wherein the filter is a ceramic monoblock filter.

8. The filter of claim 6, wherein the through-hole is partially surrounded by a patterned region.

9. The filter of claim 6, wherein the filter is a monoblock filter.

10. The filter of claim 6, wherein the through-hole is plated with a conductive material.

11. A method of creating a filter comprising:

providing a block of dielectric material for a filter, the block comprising a top surface, a bottom surface, and a side surfaces; and creating a through-hole extending through the block from the top surface to the bottom surface, wherein:

the through hole comprises a top edge that connects the top surface with an inner wall of the through-hole and a bottom edge that connects the bottom surface with the inner wall of the through-hole, the bottom edge is chamfered, and the top edge is rounded.

12. The method of creating the filter of claim 11, wherein the filter is a ceramic monoblock filter.

13. The method of creating the filter of claim 11, wherein the bottom edge corresponds with a short circuit end of the filter.

14. The method of creating the filter of claim 11, the method further comprising plating a conductive material to the through-hole.

15. The method of creating the filter of claim 11, the method further comprising:

plating a conductive material to the through-hole; and plating the conductive material to the top surface and bottom surface at least partially around an entry of the through-hole.

16. The method of creating the filter of claim 11, the method further comprising:

plating a conductive material to the block, wherein the plating of the conductive material is of approximately the same thickness on the top surface, top edge, and the inner wall of the through-hole.

17. The method of creating the filter of claim 11, wherein the filter is a monoblock filter.

* * * * *